US010584895B2

(12) United States Patent
Ipposhi et al.

(10) Patent No.: US 10,584,895 B2
(45) Date of Patent: Mar. 10, 2020

(54) HEAT UTILIZING APPARATUS

(71) Applicant: Mitsubishi Electric Corporation, Chiyoda-ku (JP)

(72) Inventors: Shigetoshi Ipposhi, Chiyoda-ku (JP); Yoshikazu Yaji, Chiyoda-ku (JP); Shunkei Suzuki, Chiyoda-ku (JP); Toshio Shinoki, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 42 days.

(21) Appl. No.: 15/745,883

(22) PCT Filed: Feb. 23, 2016

(86) PCT No.: PCT/JP2016/055205
§ 371 (c)(1),
(2) Date: Jan. 18, 2018

(87) PCT Pub. No.: WO2017/029819
PCT Pub. Date: Feb. 23, 2017

(65) Prior Publication Data

US 2018/0209689 A1 Jul. 26, 2018

(30) Foreign Application Priority Data

Aug. 17, 2015 (JP) ..... 2015-160395

(51) Int. Cl.
*F25B 29/00* (2006.01)
*F24H 4/04* (2006.01)
(Continued)

(52) U.S. Cl.
CPC ..... *F24H 4/04* (2013.01); *F24D 11/00* (2013.01); *F24H 7/04* (2013.01); *F25B 25/005* (2013.01);
(Continued)

(58) Field of Classification Search
CPC .. F25B 6/02; F25B 7/00; F25B 25/005; F03B 7/003; Y02E 60/147; F24D 11/00
See application file for complete search history.

(56) References Cited

U.S. PATENT DOCUMENTS 7,669,647 B2 * 3/2010 Tsubone ..... B60H 1/00492 165/202
2005/0061003 A1 3/2005 Miyauchi et al.
(Continued)

FOREIGN PATENT DOCUMENTS

CN 101410260 A 4/2009
JP 58-178149 A 10/1983
(Continued)

OTHER PUBLICATIONS

International Search Report dated May 17, 2016 in PCT/JP2016/055205 filed Feb. 23, 2016.
(Continued)

*Primary Examiner* — Frantz F Jules
*Assistant Examiner* — Lionel Nouketcha
(74) *Attorney, Agent, or Firm* — Oblon, McClelland, Maier & Neustadt, L.L.P.

(57) ABSTRACT

A heat utilizing apparatus includes a heat pump including a first heat exchanger and a second heat exchanger, a first heat storage unit storing heat exchanged in the first heat exchanger, a second heat storage unit storing heat exchanged in the second heat exchanger, a third heat exchanger exchanging heat with the first heat storage unit, a fourth heat exchanger exchanging heat with the second heat storage unit 8, a measurement unit measuring a heat storage amount of the first heat storage unit, a heat rejection unit reducing the heat storage amount of the first heat storage unit, a determination unit determining, in accordance with a measurement result of the measurement unit, whether to reduce the heat storage amount of the first heat storage unit and a heat
(Continued)

storage amount of the second heat storage unit, and a control unit adjusting the amount of heat to be reduced through the heat rejection unit in accordance with a determination result of the determination unit.

9 Claims, 4 Drawing Sheets

(51) Int. Cl.

| | |
|---|---|
| ***F25B 25/00*** | (2006.01) |
| ***F24H 7/04*** | (2006.01) |
| ***F24D 11/00*** | (2006.01) |
| ***F25B 30/02*** | (2006.01) |
| ***F25B 30/06*** | (2006.01) |
| *F24D 17/02* | (2006.01) |

(52) U.S. Cl.
CPC ..... *F25B 29/003* (2013.01); *F25B 30/02* (2013.01); *F25B 30/06* (2013.01); *F24D 17/02* (2013.01); *F24D 2200/123* (2013.01); *F25B 2339/042* (2013.01); *F25B 2339/047* (2013.01); *F25B 2400/24* (2013.01)

(56) References Cited

U.S. PATENT DOCUMENTS

| | | | | |
|---|---|---|---|---|
| 2011/0232890 | A9* | 9/2011 | Gering ..... | B60H 1/00278 165/202 |
| 2014/0097261 | A1* | 4/2014 | Blumenstock ..... | B60H 1/00492 237/5 |

FOREIGN PATENT DOCUMENTS

| | | | | | |
|---|---|---|---|---|---|
| JP | 58178149 | A | * | 10/1983 | ..... F28D 20/02 |
| JP | 6-58692 | A | | 3/1994 | |
| JP | 06058692 | A | * | 3/1994 | |
| JP | 6-221717 | A | | 8/1994 | |
| JP | 7-4686 | A | | 1/1995 | |
| JP | 8-35732 | A | | 2/1996 | |
| JP | 9-68364 | A | | 3/1997 | |
| JP | 2008-209038 | A | | 9/2008 | |
| JP | 2008-215780 | A | | 9/2008 | |
| JP | 2008209038 | A | * | 9/2008 | |
| JP | 2008215780 | A | * | 9/2008 | |
| JP | 2009-222383 | A | | 10/2009 | |
| JP | 2009222383 | A | * | 10/2009 | ..... F24D 11/005 |

OTHER PUBLICATIONS

Chinese Office Action issued in Chinese Patent Application No. 201680046897.9 dated Oct. 9, 2019, (w/ English Translation).

* cited by examiner

HEAT UTILIZING APPARATUS

TECHNICAL FIELD

The present invention relates to a heat utilizing apparatus.

BACKGROUND ART

A typical heat utilizing apparatus includes a heat pump that includes a compressor, a first heat exchanger, an expansion valve, and a second heat exchanger sequentially connected in a closed circuit by pipes and through which a heat medium flowing through the pipes circulates. For example, a case where the heat utilizing apparatus performs a cooling operation for cooling an indoor space will now be described on the assumption that the heat medium circulates through the heat pump while passing through the compressor, the first heat exchanger, the expansion valve, and the second heat exchanger in that order. In the heat pump, the first heat exchanger allows the heat medium flowing through the pipe to exchange heat with the outside of the heat utilizing apparatus, for example, outdoor air. Then, the expansion valve expands the heat medium flowing through the pipe, so that the heat medium decreases in temperature and thus enters a lower temperature, lower pressure state than before passing through the expansion valve. Then, the second heat exchanger allows the low temperature, low pressure heat medium to exchange heat with the outside of the heat utilizing apparatus. Specifically, the heat exchange in the second heat exchanger causes the low temperature, low pressure heat medium to transfer cooling energy to the indoor space, so that the indoor space is filled with cold air.

In the second heat exchanger, the low temperature, low pressure heat medium increases in temperature by exchanging heat with the outside of the heat utilizing apparatus, so that the heat medium has substantially the same state as that before passing through the expansion valve. Then, the compressor pressurizes the heat medium, so that the heat medium increases in temperature and thus enters a higher temperature, higher pressure state than before passing through the compressor. After that, in the first heat exchanger, the high temperature, high pressure heat medium exchanges heat with the outside of the heat utilizing apparatus. Specifically, in the first heat exchanger, the high temperature, high pressure heat medium releases its heating energy to the outside of the heat utilizing apparatus and receives heat from the outside of the heat utilizing apparatus. In the first heat exchanger, the high temperature, high pressure heat medium decreases in temperature by exchanging heat with the outside of the heat utilizing apparatus, so that the heat medium has substantially the same state as that before passing through the compressor. In other words, the heat medium has substantially the same state as that before passing through the expansion valve. Heat circulates through the heat pump.

With the above-described configuration, the heat pump produces heating energy when the heat pump is intended to produce cooling energy. In other words, the heat pump produces heat intended to be used and heat having a temperature different from the heat intended to be used. In the cooling operation, corresponding to a heat pump normal operation, of the heat utilizing apparatus, as described above, the heating energy produced in addition to the cooling energy used for cooling is rejected as waste heat to the outside of the heat utilizing apparatus through an outdoor unit (refer to, for example, Patent Literature 1). Conversely, when the heat pump is operated to produce heating energy, the heat pump produces cooling energy as well as the heating energy. In a heating operation of the heat utilizing apparatus, the cooling energy produced in addition to the heating energy used for heating is rejected as waste heat to the outside of the heat utilizing apparatus.

CITATION LIST

Patent Literature

Patent Literature 1: Japanese Unexamined Patent Application Publication No. 6-221717

SUMMARY OF INVENTION

Technical Problem

In such a heat utilizing apparatus, heat that is produced in addition to heat intended to be used and that has a temperature different from the heat intended to be used is rejected as waste heat to the outside of the heat utilizing apparatus. It is assumed that the heat utilizing apparatus includes a first heat storage unit storing heat exchanged in the first heat exchanger and a second heat storage unit storing heat exchanged in the second heat exchanger. The first heat exchanger allows the high temperature, high pressure heat medium having passed through the compressor to exchange heat with the outside of the heat utilizing apparatus. The exchanged heat is stored in the first heat storage unit. Similarly, the second heat exchanger allows the low temperature, low pressure heat medium having passed through the expansion valve to exchange heat with the outside of the heat utilizing apparatus. The exchanged heat is stored in the second heat storage unit. In other words, heat produced by operating the heat pump can be stored in the heat storage units, regardless of whether the heat is needed. When the heat is needed, the heat can be extracted from the heat storage units and be used.

For example, it is assumed that the first and second heat storage units have the same heat storage capacity, and when the amount of heat stored in each of the first and second heat storage units reaches an upper limit of the heat storage capacity, the heat pump is not further operated. In this case, for example, while the heat utilizing apparatus is used to perform the cooling operation, cooling energy is removed from the second storage unit, the removed cooling energy is used for the cooling operation, and heating energy stored in the first heat storage unit remains unchanged. While the heat utilizing apparatus is performing the heating operation, heating energy is removed from the first heat storage unit, the removed heating energy is used for the heating operation, and cooling energy stored in the second heat storage unit remains unchanged. In other words, the amount of heat stored in (or heat storage amount of) one of the heat storage units is reduced and that of the other one of the heat storage units remains unchanged.

If the heat pump is again operated to increase the heat storage amount of the heat storage unit that has experienced a reduction in heat storage amount, the heat storage amount of the heat storage unit can be increased. In contrast, the heat storage amount of the heat storage unit that has not experienced a reduction in heat storage amount will exceed the heat storage capacity, resulting in excessive heat storage in this heat storage unit. The reason is that the heat utilizing apparatus produces heat intended to be used and heat having a temperature different from the heat intended to be used. Excessively storing heat, even if only temporarily, in a heat storage unit such that the amount of stored heat exceeds the heat storage capacity of the heat storage unit will cause the material of the heat storage unit to deteriorate. Such deterioration leads to, for example, a breakage of the heat storage unit.

The present invention has been made to overcome the above-described problems and aims to provide a heat utilizing apparatus capable of storing heating energy and cooling energy produced by a heat pump and reducing or eliminating excessive heat storage exceeding a heat storage capacity of a heat storage unit.

Solution to Problem

An embodiment of the present invention provides a heat utilizing apparatus including a heat pump including a compressor, a first heat exchanger, an expansion valve, and a second heat exchanger sequentially connected in a closed circuit by a pipe through which a heat medium circulates; a first heat storage unit configured to store heat exchanged in the first heat exchanger; a second heat storage unit configured to store heat exchanged in the second heat exchanger; a third heat exchanger configured to exchange heat with the first heat storage unit; a fourth heat exchanger configured to exchange heat with the second heat storage unit; a measurement unit configured to measure a heat storage amount of the first heat storage unit; a heat rejection unit configured to reduce the heat storage amount of the first heat storage unit; a determination unit configured to determine, in accordance with a measurement result of the measurement unit, whether to reduce the heat storage amount of the first heat storage unit; and a control unit configured to control the heat rejection unit in accordance with a determination result of the determination unit.

Advantageous Effects of Invention

The heat utilizing apparatus according to the embodiment of the present invention can store heating energy and cooling energy produced by the heat pump and suppress excessive heat storage in the heat storage units. Since the apparatus includes the heat rejection unit reducing the heat storage amount of the first heat storage unit, the heat storage amount of the first heat storage unit can be adjusted not to exceed a heat storage capacity.

DESCRIPTION OF EMBODIMENTS

Embodiment 1

Figure 1:
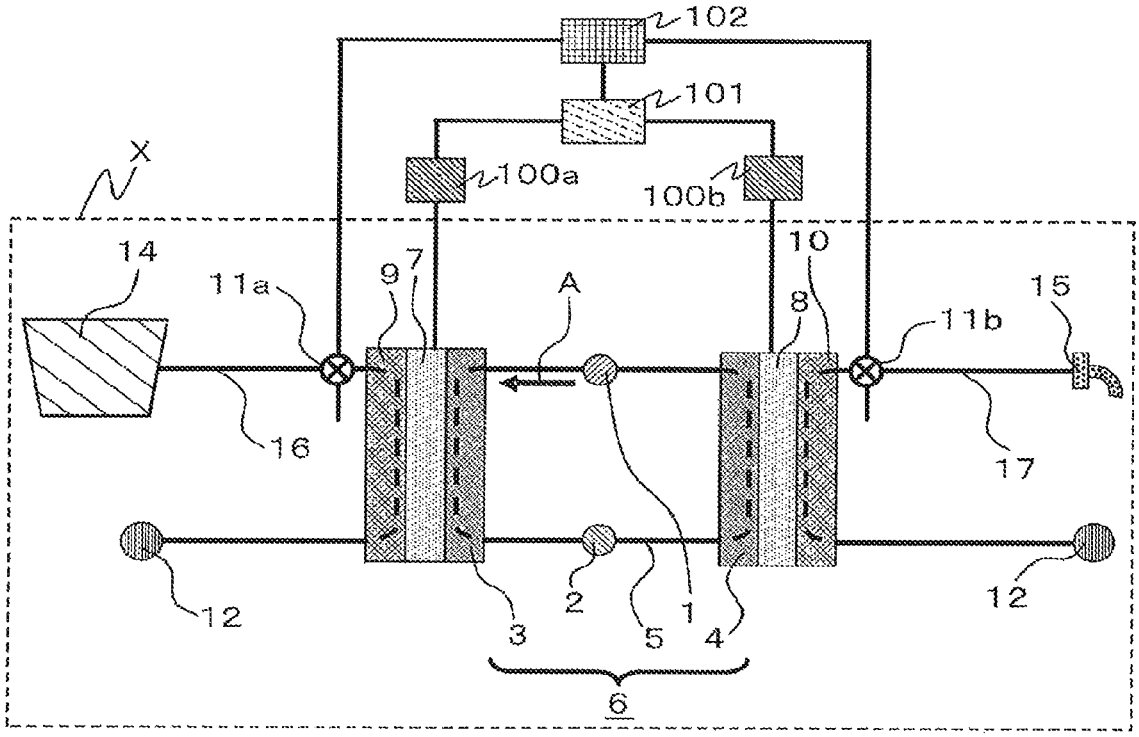
FIG. 1 is a schematic diagram illustrating the configuration of a heat utilizing apparatus according to Embodiment 1 of the present invention.

The configuration of a heat utilizing apparatus according to Embodiment 1 of the present invention will be described. FIG. 1 is a schematic diagram illustrating the configuration of the heat utilizing apparatus according to Embodiment 1 of the present invention. The heat utilizing apparatus according to Embodiment 1 includes a first heat pump 6 including a first compressor 1, a first heat exchanger 3, a first expansion valve 2, and a second heat exchanger 4 sequentially connected in a closed circuit by a first pipe 5 through which a first heat medium circulates. Embodiment 1 will be described on the assumption that the heat medium circulates through the first pipe 5 in a direction (indicated by an arrow A in FIG. 1) from, for example, the first compressor 1 to the first heat exchanger 3. Although the direction in which the heat medium flows may be changed, an operation, which will be described later, of the heat utilizing apparatus according to Embodiment 1 changes depending on the direction in which the heat medium flows. The heat utilizing apparatus according to Embodiment 1 further includes a first heat storage unit 7 storing heat exchanged in the first heat exchanger 3 and a second heat storage unit 8 storing heat exchanged in the second heat exchanger 4. The heat medium circulating through the first pipe 5 is what is generally called refrigerant. Specific examples of the refrigerant include fluorocarbon and carbon dioxide.

The heat utilizing apparatus according to Embodiment 1 further includes a third heat exchanger 9 that is disposed on an opposite side of the first heat storage unit 7 from the first heat exchanger 3 and that exchanges heat with the first heat storage unit 7 and additionally includes a fourth heat exchanger 10 that is disposed on an opposite side of the second heat storage unit 8 from the second heat exchanger 4 and that exchanges heat with the second heat storage unit 8. The heat utilizing apparatus according to Embodiment 1 further includes a first supply unit that provides a first supply necessary for life and a second supply unit that provides a second supply necessary for life. Embodiment 1 will be described on the assumption that the first supply necessary for life is hot water and the second supply necessary for life is cold water. In FIG. 1, the first supply unit includes a heating energy pipe 16 and a heat medium supply source 12 connected with the heating energy pipe 16 and supplies hot water to a bath 14 through the heating energy pipe 16 extending from the heat medium supply source 12 through the third heat exchanger 9 to the bath 14. In FIG. 1, the second supply unit includes a cooling energy pipe 17 and a heat medium supply source 12 connected with the cooling energy pipe 17 and supplies cold water to a tap 15 through the cooling energy pipe 17 extending from the heat medium supply source 12 through the fourth heat exchanger 10 to the tap 15. Each of the heat medium supply sources 12 in Embodiment 1 is, for example, a water supply that supplies tap water, etc. to the heat utilizing apparatus from the outside. Although the two different heat medium supply sources 12 are illustrated in FIG. 1, a configuration may be used in which a single heat medium supply source 12 is provided, a three-way pipe is provided to extend among the heat medium supply source 12, the third heat exchanger 9, and the fourth heat exchanger 10, and water is distributed through the pipe to the third heat exchanger 9 and the fourth heat exchanger 10.

In the heat utilizing apparatus according to Embodiment 1, the first heat storage unit 7 is sandwiched between the first heat exchanger 3 and the third heat exchanger 9, and outer surfaces of the first heat storage unit 7 are in contact with an outer surface of the first heat exchanger 3 and that of the third heat exchanger 9. Such arrangement enables heat exchanged in the first heat exchanger 3 to be directly transferred to the first heat storage unit 7 without passing through an additional pipe, for example. Specifically, in the first heat exchanger 3, the heat of the heat medium circulating through the heat pump is directly transferred to the first heat storage unit 7. This suppresses heat loss during heat transfer from the first heat exchanger 3 to the first heat storage unit 7. Similarly, the heat in the first heat storage unit 7 can be directly transferred to the third heat exchanger 9 without passing through an additional pipe, for example. This suppresses heat loss during heat transfer from the first heat storage unit 7 to the third heat exchanger 9.

The second heat storage unit 8 is also sandwiched between the second heat exchanger 4 and the fourth heat exchanger 10 in a manner similar to the arrangement of the first heat storage unit 7. Outer surfaces of the second heat storage unit 8 are in contact with an outer surface of the second heat exchanger 4 and that of the fourth heat exchanger 10. Such arrangement of the second heat storage unit 8 suppresses heat loss during heat transfer from the second heat exchanger 4 to the second heat storage unit 8 and during heat transfer from the second heat storage unit 8 to the fourth heat exchanger 10 in a manner similar to the arrangement of the first heat storage unit 7.

Although the first heat storage unit 7 is sandwiched between the first heat exchanger 3 and the third heat exchanger 9 in Embodiment 1, any other arrangement may be used, provided that heat exchanged in the first heat exchanger 3 can be transferred to the first heat storage unit 7 and heat stored in the first heat storage unit 7 can be transferred to the third heat exchanger 9. A structure into which the first beat exchanger 3, the first heat storage unit 7, and the third heat exchanger 9 are integrated. For example, a plate heat exchanger or a shell and tube heat exchanger, may be used with such a configuration. The same applies to the arrangement of the second heat storage unit 8, the second heat exchanger 4, and the fourth heat exchanger 10.

The heat utilizing apparatus according to Embodiment 1 further includes a measurement unit measuring a heat storage amount of the first heat storage unit 7. In a case where the heat utilizing apparatus includes a plurality of heat storage units (which the first heat storage unit 7 and the second heat storage unit 8 in Embodiment 1 are collectively referred to as), a heat storage unit whose heat storage amount is measured in an operation of the heat utilizing apparatus in Embodiment 1 is referred to as the first heat storage unit 7 in Embodiment 1. In FIG. 1, the heat utilizing apparatus further includes a first measurement unit 100*a* that measures the heat storage amount of the first heat storage unit 7 and a second measurement unit 100*b* that measures a heat storage amount of the second heat storage unit 8. The first measurement unit 100*a* and the second measurement unit 100*b* may be integrated into a single structure and measurement results may be collectively output to a determination unit 101. The heat utilizing apparatus according to Embodiment 1 further includes the determination unit 101 determining, in accordance with the measurement results of the measurement units, whether to reduce the heat storage amount of the first heat storage unit 7 and that of the second heat storage unit 8. In FIG. 1, the heat utilizing apparatus further includes the determination unit 101 that determines, in accordance with the measurement results of the measurement units, which of the first heat storage unit and the second heat storage unit has a less available capacity and a control unit 102 that controls a heat rejection unit in accordance with a determination result of the determination unit 101. As will be described later, the determination unit 101 and the control unit 102 perform, for example, calculation and signal transmission, and include electric circuitry.

The heat utilizing apparatus according to Embodiment 1 further includes a heat rejection unit reducing the heat storage amount of the first heat storage unit 7. In the case where the heat utilizing apparatus includes a plurality of heat storage units, a heat storage unit whose heat storage amount is reduced in an operation of the heat utilizing apparatus according to Embodiment 1 is referred to as the first heat storage unit 7 in Embodiment 1. In FIG. 1, the heat rejection unit includes a first heat rejection unit 11*a* that reduces the heat storage amount of the first heat storage unit 7 and a second heat rejection unit 11*b* that reduces the heat storage amount of the second heat storage unit 8.

The first heat rejection unit 11*a* and the second heat rejection unit 11*b* are used, for example, when the heat storage amount of the first heat storage unit 7 differs from that of the second heat storage unit 8, or when the available capacity of the first heat storage unit 7 differs from that of the second heat storage unit 8. In addition, the first heat rejection unit 11*a* and the second heat rejection unit 11*b* are used so that the heat storage amount of the first heat storage unit 7 does not exceed a heat storage capacity of the first heat storage unit 7 and the heat storage amount of the second heat storage unit 8 does not exceed a heat storage capacity of the second heat storage unit.

The term "heat storage capacity" as used herein refers to a maximum heat storage amount that the heat storage amount must not exceed so that the heat storage unit functions properly. The heat storage capacity is heat energy that can be specified at any value by a designer. The heat storage capacity is determined by obtaining a reference value based on, for example, an upper limit of temperature increase and a lower limit of temperature decrease associated with the characteristics of the heat pump 6, an upper limit temperature and a lower limit temperature beyond which the performance of a refrigeration cycle degrades, and heat-resistant temperatures and pressure resistances of components constituting the heat pump 6, and considering the factor of safety in the reference value. It is preferred to set an upper temperature limit lower than the boiling temperature (which depends on the pressure of the heat medium; for example, 100 degrees C. in the use of water at atmospheric pressure) of the heat medium, because this setting can suppress the likelihood that the heat medium will boil and the boiling will in turn cause ejection of high temperature steam or pulsating flow.

Referring to FIG. 1, the first heat rejection unit 11*a* is disposed at a position that is not the both ends of the heating energy pipe 16 such that hot water in the heating energy pipe 16 having passed through the third heat exchanger 9 can be discharged by the first heat rejection unit 11*a*. The second heat rejection unit 11*b* is disposed at a position that is not the both ends of the cooling energy pipe 17 such that cold water in the cooling energy pipe 17 having passed through the fourth heat exchanger 10 can be discharged by the second heat rejection unit 11*b*. In FIG. 1, an X portion within a dashed line corresponds to a heat cycle portion of the heat utilizing apparatus according to Embodiment 1. This portion is within the dashed line for description of the subsequent figures.

Detailed operations of, for example, the first measurement unit 100*a*, the second measurement unit 100*b*, the determination unit 101, the control unit 102, the first heat rejection unit 11*a*, and the second heat rejection unit 11*b* will be described later.

An operation of the heat utilizing apparatus according to Embodiment 1 of the present invention will now be described with reference to FIG. 1. It is assumed in Embodiment 1 that the heat medium circulates through the first pipe 5 in the direction (indicated by the arrow A in FIG. 1) from the first compressor 1 to the first heat exchanger 3. A case where hot water is supplied to the bath 14 and cold water is supplied to the tap 15 in FIG. 1 will be described as an example. Furthermore, it is assumed in Embodiment 1 that the first heat storage unit 7 and the second heat storage unit 8 have the same heat storage capacity. If the amount of heat stored in each heat storage unit exceeds the heat storage capacity, the material of the heat storage unit will deteriorate, leading to a breakage of the heat storage unit.

The first heat pump 6 is first activated. Since the heat medium circulates through the first pipe 5, the first heat exchanger 3 will be first described as a starting point of circulation. In the first heat pump 6, the first heat exchanger 3 allows the heat medium flowing through the first pipe 5 to exchange heat with the outside of the heat utilizing apparatus. Then, the first expansion valve 2 expands the heat medium flowing through the first pipe 5 to reduce the temperature of the heat medium, so that the heat medium enters a lower temperature, lower pressure state than before passing through the first expansion valve 2. After that, the second heat exchanger 4 allows the low temperature, low pressure heat medium to exchange heat with the outside of the heat utilizing apparatus.

In the second heat exchanger 4, the low temperature, low pressure heat medium increases in temperature by exchanging heat with the outside of the heat utilizing apparatus, so that the heat medium has substantially the same state as that before passing through the first expansion valve 2. Then, the first compressor 1 compresses the heat medium to further increase the temperature of the heat medium, so that the heat medium enters a higher temperature, higher pressure state than before passing through the first compressor 1. Then, the first heat exchanger 3 allows the high temperature, high pressure heat medium to exchange heat with the outside of the heat utilizing apparatus.

In the first heat exchanger 3, the high temperature, high pressure heat medium decreases in temperature by exchanging heat with the outside of the heat utilizing apparatus, so that the heat medium has substantially the same state as that before passing through the first compressor 1. In other words, the heat medium has the same state as that before passing through the first compressor 1. The heat cycle is thus established in the first heat pump 6.

In the first heat exchanger 3, heat exchanged between the outside of the heat exchanger and the heat medium flowing through the first pipe 5 is transferred to the first heat storage unit 7. The transferred heat is stored in the first heat storage unit 7. In the second heat exchanger 4, heat exchanged between the outside of the heat exchanger and the heat medium flowing through the first pipe 5 is transferred to the second heat storage unit 8. The transferred heat is stored in the second heat storage unit 8. In Embodiment 1, when the heat storage amount of the first heat storage unit 7 and that of the second heat storage unit 8 reach an upper limit of the heat storage capacity, that is, when there is substantially no available capacity, the heat pump is not further operated.

When hot water is intended to be supplied to the bath 14, the heat medium supply source 12 supplies water to the heating energy pipe 16. The third heat exchanger 9 allows the water passing through the heating energy pipe 16 to exchange heat with the first heat storage unit 7. The water in the heating energy pipe 16 becomes hot water by passing through the third heat exchanger 9. The hot water is supplied to the bath 14. The term "hot water" as used herein refers to water warmer than the water supplied from the heat medium supply source 12.

When cold water is intended to be supplied to the tap 15, the heat medium supply source 12 supplies water to the cooling energy pipe 17. The fourth heat exchanger 10 allows the water passing through the cooling energy pipe 17 to exchange heat with the second heat storage unit 8. The water in the cooling energy pipe 17 becomes cold water by passing through the fourth heat exchanger 10. The cold water is supplied through the tap 15. The term "cold water" as used herein refers to water colder than the water supplied from the heat medium supply source 12.

When the amount of heat removed from the first heat storage unit 7 during supply of the hot water to the bath 14 is equal to the amount of heat removed from the second heat storage unit 8 during supply of the cold water to the tap 15, the available capacity of the first heat storage unit 7 is equal to that of the second heat storage unit 8. To store heat in the first heat storage unit 7 and the second heat storage unit 8 until the heat storage amount of each of the first heat storage unit 7 and the second heat storage unit 8 reaches the upper limit of the heat storage capacity, the operation of the first heat pump 6 may be restarted without any processing. Storing heat up to the heat storage capacity means maximizing the heat storage amount of each of the first heat storage unit 7 and the second heat storage unit 8.

If the amount of heat removed from the first heat storage unit 7 is greater than that from the second heat storage unit 8 in, for example, winter, and the operation of the first heat pump 6 is restarted without any processing so that the heat storage amount of the first heat storage unit 7 and that of the second heat storage unit 8 are maximized, the heat storage amount of the second heat storage unit 8 will exceed the heat storage capacity, causing excessive heat storage. The reason is that the available capacity of the first heat storage unit 7 differs from that of the second heat storage unit 8 and the available capacity of the second heat storage unit 8 is less than that of the first heat storage unit 7. If heat is excessively stored, if only temporarily, in the second heat storage unit 8 such that the heat storage amount exceeds the heat storage capacity, the material of the second heat storage unit 8 will deteriorate, leading to a breakage, for example. A breakage may result in loss of energy as heat to be stored in the second heat storage unit 8.

For this reason, before the operation of the first heat pump 6 is restarted, the second heat rejection unit 11*b* is used to reduce the heat storage amount of the second heat storage unit 8 such that the available capacity of the second heat storage unit 8 is substantially equal to that of the first heat storage unit 7. In FIG. 1, water is supplied from the heat medium supply source 12 to the cooling energy pipe 17, the water is allowed to pass through the fourth heat exchanger 10, and cold water is discharged from the second heat rejection unit 11*b*, thereby causing the available capacity of the second heat storage unit 8 to be substantially equal to the available capacity of the first heat storage unit 7.

In contrast, when the amount of heat removed from the second heat storage unit 8 is greater than that from the first heat storage unit 7 in, for example, summer, the first heat rejection unit 11*a* is used to reduce the heat storage amount of the first heat storage unit 7 before the operation of the first heat pump 6 is restarted, thereby causing the available capacity of the first heat storage unit 7 to be substantially equal to the available capacity of the second heat storage unit 8.

Although the heat storage amount of either one of the heat storage units is reduced before the operation of the first heat pump 6 is restarted in the above description, the heat storage amount of the heat storage unit may be reduced at any other time. The heat storage amount of the heat storage unit may be reduced simultaneously with restart of the operation of the first heat pump 6. The heat storage amount of the heat storage unit may be reduced after the operation of the first heat pump 6 is restarted and before heat is excessively stored in the heat storage unit such that the heat storage amount exceeds the heat storage capacity.

Figure 2:
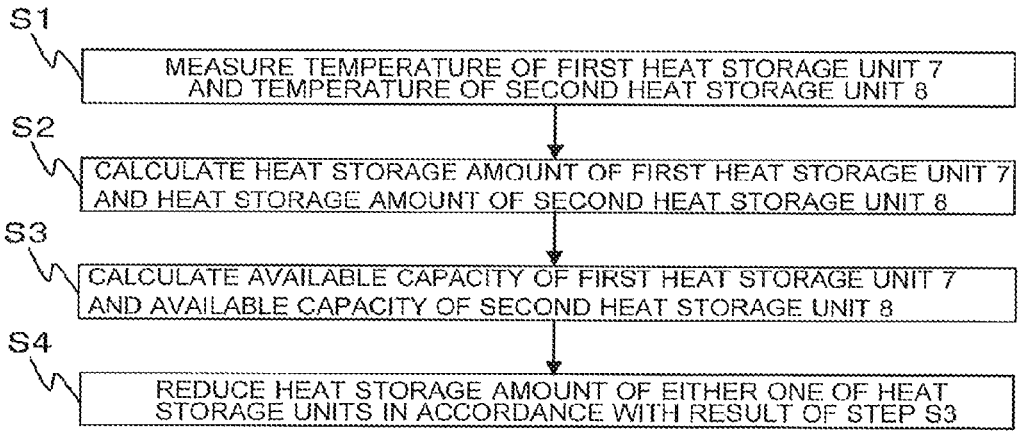
FIG. 2 is a flowchart describing use of heat rejection units of the heat utilizing apparatus according to Embodiment 1 of the present invention.

How to reduce the heat storage amount of either one of the heat storage units will now be described in detail. FIG. 2 is a flowchart describing use of the heat rejection units of the heat utilizing apparatus according to Embodiment 1 of the present invention. Referring to FIG. 2, in step S1, the temperature of the first heat storage unit 7 and that of the second heat storage unit 8 are measured. In step S2, the heat storage amount of the first heat storage unit 7 and that of the second heat storage unit 8 are calculated. Then, in step S3, the available capacity of the first heat storage unit 7 and that of the second heat storage unit 8 are calculated. In step S4, the heat storage amount of either one of the heat storage units is reduced based on a result obtained in step S3 through the corresponding heat rejection unit.

Each of the above-described steps will now be described in more detail. In step S1, the temperature of the first heat storage unit 7 is measured using the first measurement unit 100*a* and the temperature of the second heat storage unit 8 is measured using the second measurement unit 100*b*. Examples of the measurement unit used include a thermocouple and a thermistor.

Then, in step S2, the first measurement unit 100*a* calculates the heat storage amount of the first heat storage unit 7, and the second measurement unit 100*b* calculates the heat storage amount of the second heat storage unit 8. The heat storage amount Q1 [J] of the first heat storage unit 7 is obtained by multiplying a difference T1 [K] between the temperature of the first heat storage unit 7 and the temperature of the outside of the heat utilizing apparatus, mass M1 [kg] of the first heat storage unit 7, and specific heat Cp1 [J/(kg×K)] of a material for the first heat storage unit 7 together. The heat storage amount Q2 [J] of the second heat storage unit 8 is similarly obtained by multiplying a difference T2 [K] between the temperature of the second heat storage unit 8 and the temperature of the outside of the heat utilizing apparatus, mass M2 [kg] of the second heat storage unit 8, and specific heat Cp2 [J/(kg×K)] of a material for the second heat storage unit 8 together.

Although the temperature differences T1 [K] and T2 [K] are calculated based on the "temperature of the outside of the heat utilizing apparatus" in the above description, the "temperature of the outside of the heat utilizing apparatus" does not necessarily have to be measured and used. The differences may be obtained based on any determined reference temperature (e.g., 25 degrees C. or 0 degrees C.).

Steps S1 and S2 may be performed together and the first measurement unit 100*a* may directly measure the heat storage amount of the first heat storage unit 7. Similarly, the second measurement unit 100*b* may directly measure the heat storage amount of the second heat storage unit 8. Measurement results about the first heat storage unit 7 and the second heat storage unit 8 obtained by the measurement units are output to the determination unit 101.

Then, in step S3, the determination unit 101 calculates the available capacity of the first heat storage unit 7 and that of the second heat storage unit 8. The heat storage capacity of the first heat storage unit 7 and that of the second heat storage unit 8 are recorded in the determination unit 101 in advance. The heat storage capacity of the first heat storage unit 7 and that of the second heat storage unit 8 are known at the time of purchase or manufacture of the heat storage units. The available capacity Q3 [J] of the first heat storage unit 7 is obtained from the difference between the heat storage capacity $Q_{max}$1 [J] of the first heat storage unit 7 and Q1 [J] obtained in step S2. The available capacity Q4 [J] of the second heat storage unit 8 is similarly obtained from the difference between the heat storage capacity $Q_{max}$2 [J] of the second heat storage unit 8 and Q2 [J] obtained in step S2.

The determination unit 101 compares the available capacity Q3 [J] of the first heat storage unit 7 with the available capacity Q4 [J] of the second heat storage unit 8, thus determining whether the heat storage unit having a less value is the first heat storage unit 7 or the second heat storage unit 8. Specifically, the determination unit 101 determines which of the available capacity Q3 [J] of the first heat storage unit and the available capacity Q4 [J] of the second heat storage unit is less, thereby determining which of the heat storage amount of the first heat storage unit 7 and that of the second heat storage unit 8 is to be reduced. For example, it is assumed that Q3 [J] is less than Q4 [J]. Specifically, it is assumed that the available capacity Q3 [J] of the first heat storage unit 7 is the less and the heat storage amount of the first heat storage unit 7 should be reduced. In this case, the determination unit 101 transmits a signal indicating that Q3 [J] is less than Q4 [J] and the heat storage amount of the first heat storage unit 7 should be reduced and indicating the difference between Q3 [J] and Q4 [J] to the control unit 102.

Finally, in step S4, the heat storage amount of either one of the heat storage units is reduced based on the result of step S3 through the corresponding heat rejection unit. The control unit 102 adjusts the amount of heat to be reduced through the heat rejection unit in accordance with a determination result of the determination unit 101. In Embodiment 1, the control unit 102 sends a command to reduce the heat storage amount of the first heat storage unit 7 to the first heat rejection unit 11*a* in accordance with the signal from the determination unit 101. In this case, the heat storage amount to be reduced corresponds to the difference between the available capacity Q3 [J] of the first heat storage unit 7 and the available capacity Q4 [J] of the second heat storage unit 8. If the heat storage amount of the first heat storage unit 7 is reduced by the difference between Q3 [J] and Q4 [J] through the first heat rejection unit 11*a*, the temperature of the first heat storage unit 7 will fall.

Reducing the heat storage amount of the first heat storage unit 7 means rejecting heat from the first heat storage unit 7. In FIG. 1, heat rejection is performed by discharging water from the first heat rejection unit 11*a*, serving as a three-way valve. First, the heat medium supply source 12 supplies water to the heating energy pipe 16. The third heat exchanger 9 allows heat of the first heat storage unit 7 to be exchanged with the water flowing through the heating energy pipe 16. The water in the heating energy pipe 16 having passed through the third heat exchanger becomes hot water by passing through the third heat exchanger 9 and is then discharged from the first heat rejection unit 11*a*, thus reducing the heat storage amount of the first heat storage unit 7.

It is assumed that as a result of comparison between the available capacity Q3 [J] of the first heat storage unit 7 and the available capacity Q4 [J] of the second heat storage unit 8 in step S3, Q4 [J] is less than Q3 [J]. Specifically, it is assumed that the available capacity Q4 [J] of the second heat storage unit 8 is less and the heat storage amount of the second heat storage unit 8 should be reduced. In this case, if the heat storage amount of the second heat storage unit 8 is reduced by the difference between Q3 [J] and Q4 [J] through the second heat rejection unit 11*b*, the temperature of the second heat storage unit 8 will rise.

Reducing the heat storage amount of the second heat storage unit 8 means rejecting heat from the second heat storage unit 8. In FIG. 1, heat rejection is performed by discharging water from the second heat rejection unit 11*b*, serving as a three-way valve. First, the heat medium supply source 12 supplies water to the cooling energy pipe 17. The fourth heat exchanger 10 allows heat of the second heat storage unit 8 to be exchanged with the water flowing through the cooling energy pipe 17. The water becomes cold water by passing through the fourth heat exchanger 10 and is then discharged from the second heat rejection unit 11*b*, thus reducing the heat storage amount of the second heat storage unit 8.

Figure 3:
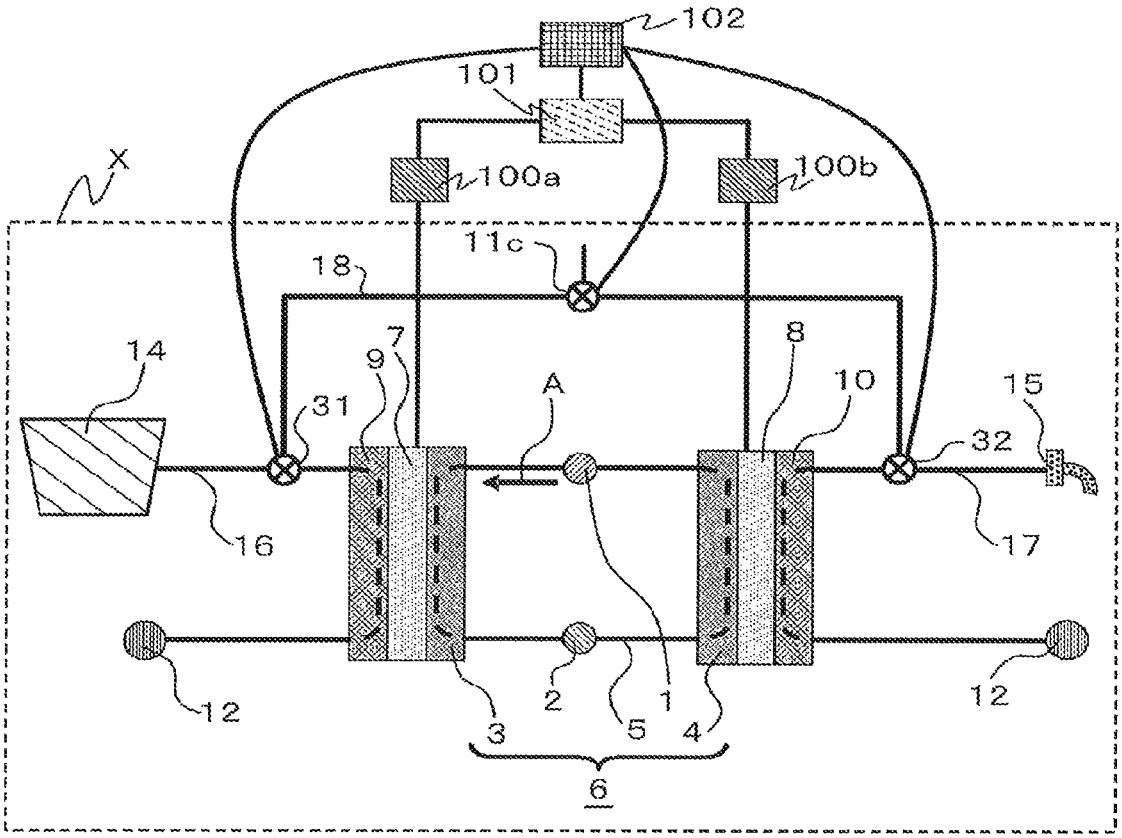
FIG. 3 is a schematic diagram illustrating a modification of the heat utilizing apparatus according to Embodiment 1 of the present invention.

FIG. 3 is a schematic diagram illustrating a modification of the heat utilizing apparatus according to Embodiment 1 of the present invention. In FIG. 3, a first three-way valve 31 is disposed at a position that is not the both the ends of the heating energy pipe 16, and the position corresponds to the first heat rejection unit 11*a* in FIG. 1. In addition, a second three-way valve 32 is disposed at a position that is not the both the ends of the cooling energy pipe 17, and the position corresponds to the second heat rejection unit 11*b* in FIG. 1. Furthermore, a heating/cooling pipe 18 connecting the first three-way valve 31 and the second three-way valve 32 is provided and a third heat rejection unit 11*c* is disposed at a position that is not the both ends of the heating/cooling pipe 18. In FIG. 3, adjusting the first three-way valve 31 and the second three-way valve 32 reduces the heat storage amount of the first heat storage unit 7 or the second heat storage unit 8 through the third heat rejection unit 11*c*.

Specifically, the third heat rejection unit 11*c* is configured to reduce the heat storage amount of the first heat storage unit 7 when the available capacity Q3 [J] of the first heat storage unit 7 differs from the available capacity Q4 [J] of the second heat storage unit 8 and the available capacity Q3 [J] of the first heat storage unit 7 is the less, and reduce the heat storage amount of the second heat storage unit 8 when the available capacity Q3 [J] of the first heat storage unit 7 is the greater.

Figure 4:
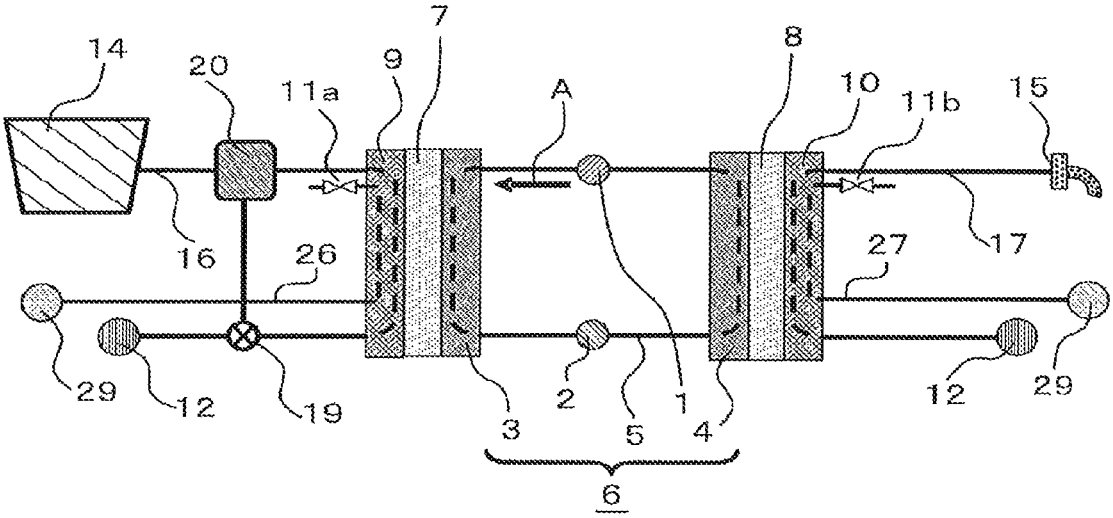
FIG. 4 is a schematic diagram illustrating only a heat cycle portion of another modification of the heat utilizing apparatus according to Embodiment 1 of the present invention.

FIG. 4 is a schematic diagram illustrating only a heat cycle portion of another modification of the heat utilizing apparatus according to Embodiment 1 of the present invention. In other words, FIG. 4 illustrates only the portion corresponding to the insides of the X portions within the dashed lines in FIGS. 1 and 3. In FIG. 4, the first supply unit includes a mixing tank 20 in which water supplied directly from the heat medium supply source 12 is mixed with water supplied through the third heat exchanger 9 from the heat medium supply source 12. A third three-way valve 19 is disposed at a position that is not the both the ends of the heating energy pipe 16. Adjusting the third three-way valve 19 allows water to be supplied to the tank from the heat medium supply source 12 without passing through the third heat exchanger 9 or to be supplied to the mixing tank 20 from the heat medium supply source 12 through the third heat exchanger 9. Consequently, the temperature of hot water to be supplied to the bath 14 can be adjusted.

It is needless to say that, like the first supply unit, the second supply unit may include a mixing tank in which water supplied directly from the heat medium supply source 12 is mixed with water supplied through the fourth heat exchanger 10 from the heat medium supply source 12. Specifically, a three-way valve may be disposed at a position that is not the both the ends of the cooling energy pipe 17 such that water is supplied to the mixing tank from the heat medium supply source 12 without passing through the fourth heat exchanger 10 or is supplied to the mixing tank from the heat medium supply source 12 through the fourth heat exchanger 10 as necessary. Consequently, the temperature of cold water to be supplied to the tap 15 can be adjusted. Furthermore, each of the first supply unit and the second supply unit may include a mixing tank.

A heat utilizing apparatus of FIG. 4 further includes a first pipe 26, a second pipe 27, and wastewater supply sources 29. The wastewater supply sources are respectively connected with the first discharge pipe 26 and the second discharge pipe 27. Referring to FIG. 4, the first heat rejection unit 11*a* is disposed at a position that is not the both ends of the first discharge pipe 26 such that a substance in the first discharge pipe 26 having passed through the third heat exchanger 9 can be discharged from the first heat rejection unit 11*a* at the position. The second heat rejection unit 11*b* is disposed at a position that is not the both ends of the second discharge pipe 27 such that a substance in the second discharge pipe 27 having passed through the fourth heat exchanger 10 can be discharged from the second heat rejection unit 11*b* at the position. Each of the wastewater supply sources 29 supplies domestic wastewater to the corresponding one of the first discharge pipe 26 and the second discharge pipe 27. The term "domestic wastewater" as used herein refers to used water, such as remaining water in a bath or water that has been used for washing. Although the wastewater supply sources 29 are intended for home use in the above description, each of the wastewater supply sources 29 may supply wastewater from, for example, a shop, a building, or a factory, to the corresponding one of the first discharge pipe 26 and the second discharge pipe 27.

Referring to FIG. 4, the wastewater supply source 29 supplies domestic wastewater to the first discharge pipe 26. The domestic wastewater in the first discharge pipe 26 becomes hot domestic wastewater by passing through the third heat exchanger 9 and is then discharged from the first heat rejection unit 11*a*. In other words, the domestic wastewater, serving as a heat medium, reduces the heat storage amount of the first heat storage unit 7. In addition, the wastewater supply source 29 supplies domestic wastewater to the second discharge pipe 27. The domestic wastewater in the second discharge pipe 27 having passed through the fourth heat exchanger 10 is discharged from the second heat rejection unit 11*b*. In other words, the domestic wastewater, serving as a heat medium, reduces the heat storage amount of the second heat storage unit 8. The first discharge pipe 26 may be connected with the second discharge pipe 27. The first discharge pipe 26 passing through the third heat exchanger 9 may be connected with the second discharge pipe 27 passing through the fourth heat exchanger 10 and a three-way valve, serving as a heat rejection unit, may be disposed at a connection point between the pipes. In this case, adjusting the three-way valve reduces the heat storage amount of the first heat storage unit 7 or the second heat storage unit 8. In FIG. 4, the domestic wastewater, serving as a heat medium, reduces the heat storage amount of the first heat storage unit 7 or the second heat storage unit 8, which can reduce water charge.

As described above, the heat utilizing apparatus according to Embodiment 1 can store heating energy and cooling energy produced by the first heat pump 6 and suppress the likelihood that heat may be excessively stored in the heat storage units such that the heat storage amount exceeds the heat storage capacity. Since the heat utilizing apparatus includes the heat rejection units configured to reduce the heat storage amount of the first heat storage unit when the available capacity Q3 [J] of the first heat storage unit is less than the available capacity Q4 [J] of the second heat storage unit, and reduce the heat storage amount of the second heat storage unit when the available capacity Q3 [J] of the first heat storage unit is greater than the available capacity Q4 [J] of the second heat storage unit, the heat storage amount and the available capacity of the first heat storage unit can be made substantially equal to those of the second heat storage unit. Thus, the heat storage amount of each heat storage unit can be adjusted not to exceed the heat storage capacity.

In Embodiment 1, when the available capacity of the first heat storage unit 7 differs from that of the second heat storage unit 8, the heat storage amount of the heat storage unit having a less available capacity is reduced by the difference between the available capacities. However, the heat storage amount may be reduced in any other manner. The heat storage amount of the first heat storage unit 7 or the second heat storage unit 8 may be reduced in accordance with measurement results of the heat storage amount of the first heat storage unit 7 and that of the second heat storage unit 8 obtained in step S2, through the corresponding heat rejection unit. Some modifications will be described below. The following description will be focused on differences from the above-described steps.

According to a first modification, in step S3, the determination unit 101 compares the heat storage capacity $Q_{max}$1 [J] of the first heat storage unit 7 with the heat storage amount Q1 [J] of the first heat storage unit 7. Then, the determination unit 101 calculates the difference between Q1 [J] and $Q_{max}$1 [J]. When the calculated difference between Q1 [J] and $Q_{max}$1 [J] is less than a predefined reference value, the determination unit 101 transmits a signal indicating that the heat storage amount of the first heat storage unit 7 should be reduced to the control unit 102. In this case, the heat storage amount to be reduced is the difference between the predefined reference value and the difference between Q1 [J] and $Q_{max}$1 [J], for example. The signal indicating the difference is transmitted to the control unit 102.

Although the difference between Q1 [J] and $Q_{max}$1 [J] is obtained in the above description, obtaining the ratio of Q1 [J] to $Q_{max}$1 [J] may be possible instead. When the ratio of Q1 [J] to $Q_{max}$1 [J] is greater than a predefined reference value, a signal indicating that the heat storage amount of the first heat storage unit 7 should be reduced is transmitted to the control unit 102. In this case, the heat storage amount to be reduced is the difference between the predefined reference value and the ratio of Q1 [J] to $Q_{max}$1 [J], for example. The signal indicating the difference is transmitted to the control unit 102. In step S3, the second heat storage unit 8 is also subjected to the same processing as that performed on the first heat storage unit 7.

According to a second modification, in step S3, the determination unit 101 calculates the available capacity Q3 [J] of the first heat storage unit 7 and the available capacity Q4 [J] of the second heat storage unit 8. The way of calculation is as described above. The determination unit 101 compares the heat storage capacity $Q_{max}$1 [J] of the first heat storage unit 7 with the available capacity Q3 [J] of the first heat storage unit 7. Then, the determination unit 101 calculates the difference between Q3 [J] and $Q_{max}$1 [J]. When the calculated difference between Q3 and $Q_{max}$1 [J] is greater than a predefined reference value, the determination unit 101 transmits a signal indicating the heat storage amount of the first heat storage unit 7 should be reduced to the control unit 102. In this case, the heat storage amount to be reduced is the difference between the predefined reference value and the difference between Q3 [J] and $Q_{max}$1 [J], for example. The signal indicating the difference is transmitted to the control unit 102.

Although the difference between Q3 [J] and $Q_{max}$1 [J] is obtained in the above description, the ratio of Q3 [J] to $Q_{max}$1 [J] may be obtained. When the ratio of Q3 [J] to $Q_{max}$1 [J] is less than a predefined reference value, a signal indicating that the heat storage amount of the first heat storage unit 7 should be reduced is transmitted to the control unit 102. In this case, the heat storage amount to be reduced is the difference between the predefined reference value and the ratio of Q3 [J] to $Q_{max}$1 [J], for example. The signal indicating the difference is transmitted to the control unit 102. In step S3, the second heat storage unit 8 is also subjected to the same processing as that performed on the first heat storage unit 7.

According to a third modification, in step S3, the determination unit 101 compares the heat storage amount Q1 [J] of the first heat storage unit 7 with the heat storage amount Q2 [J] of the second heat storage unit 8, thereby determining whether the heat storage unit having a greater value is the first heat storage unit 7 or the second heat storage unit 8. In other words, the determination unit 101 determines which of the heat storage amount Q1 [J] and the heat storage amount Q2 [J] is greater, thereby determining which of the heat storage amount of the first heat storage unit 7 and that of the second heat storage unit 8 is to be reduced. The determination unit 101 transmits a signal indicating the determined heat storage unit whose heat storage amount should be reduced and the difference between Q1 [J] and Q2 [J] to the control unit 102.

If the first heat storage unit 7 and the second heat storage unit 8 have the same heat storage capacity, the calculation of the available capacity of the first heat storage unit 7 and that of the second heat storage unit 8 can be omitted. Then, the heat storage amount of either one of the heat storage units can be adjusted based on the calculated heat storage amounts such that the heat storage amount of the first heat storage unit 7 is substantially equal to that of the second heat storage unit 8 by calculating the heat storage amounts of the heat storage units. Consequently, the number of calculations in step S3 can be reduced.

Although Embodiment 1 has been described on the assumption that the first heat storage unit 7 and the second heat storage unit 8 have the same heat storage capacity, the heat storage units may have different heat storage capacities. The heat storage unit located on a side where a large amount of heat is always used is previously allowed to have a greater heat storage capacity than the heat storage unit located on a side where a large amount of heat is not used. This results in a reduction in the number of times that the heat storage amount of the heat storage unit located on the side where a large amount of heat is always used reaches 0 [J]. Thus, the number of times that the heat pump is activated can be reduced.

Although the heat storage amount of the first heat storage unit 7 and that of the second heat storage unit 8 are calculated based on a measured temperature of the first heat storage unit 7 and that of the second heat storage unit 8 in Embodiment 1, the heat storage amounts may be obtained in any other way. Although the available capacity of the first heat storage unit 7 and that of the second heat storage unit 8 are obtained based on the difference between the heat storage capacity and the heat storage amount of the first heat storage unit 7 and that of the second heat storage unit 8, the available capacities may be obtained in any other way.

When a plurality of heat storage units are arranged, it is arbitrary to refer to, one or some of them as the first heat storage unit 7 and the other or others as the second heat storage unit 8. In Embodiment 1, at least the first heat storage unit 7 is equipped with the first heat rejection unit 11*a*. Although the temperature of the first heat storage unit 7 and that of the second heat storage unit 8 are measured in Embodiment 1, the temperature of only one of the heat storage units may be measured. For example, a measurement unit may measure the temperature of a heat storage unit on a side where a large amount of heat is always used and heat may be rejected only from the heat storage unit whose temperature is measured.

In a traditional heat utilizing apparatus, such as an air-conditioning apparatus or a natural-refrigerant heat-pump hot water apparatus, heat that is produced in addition to heat intended to be used and that has a temperature different from the heat intended to be used is rejected as waste heat to the outside of the heat utilizing apparatus. Such a traditional heat utilizing apparatus, therefore, needs an outdoor unit as a device for rejecting waste heat. The outdoor unit included in the traditional heat utilizing apparatus has a large size because it rejects extra heat, which is produced through heat pump operation by the same amount as that of heat intended to be used and which has a temperature different from the heat intended to be used, to the outside of the heat utilizing apparatus.

In contrast, the heat utilizing apparatus according to Embodiment 1 stores extra heat, which is produced in addition to heat intended to be used and which has a temperature different from the heat intended to be used, in the heat storage units instead of rejecting the heat as waste heat to the outside of the apparatus. Therefore, the apparatus eliminates the need for an outdoor unit, which is included in a traditional heat utilizing apparatus and functions as a device for rejecting waste heat. If an outdoor unit included in a traditional heat utilizing apparatus has a function other than the function of rejecting heat that is produced in addition to heat intended to be used and that has a temperature different from the heat intended to be used, the outdoor unit can include only components corresponding to those of the first heat pump 6 to be arranged in an outdoor space and thus can be downsized. The heat utilizing apparatus according to Embodiment 1 may include such a small outdoor unit.

This eliminates the need for a large occupancy space including an exhaust space surrounding the outdoor unit installed. The heat rejection units included in the heat utilizing apparatus according to Embodiment 1 are configured merely to, when the available capacity of the first heat storage unit 7 differs from that of the second heat storage unit 8, reject heat corresponding to the difference between the available capacities. The heat rejection units do not have to exchange heat with outdoor ambient air. The heat rejection units can be arranged in an indoor space, such as a dedicated storage room (including a basement), a space under a floor, or a space in a wall. As described above, the heat utilizing apparatus according to Embodiment 1 can be made smaller than traditional heat utilizing apparatuses.

Furthermore, the traditional heat utilizing apparatuses need complicated arrangement of pipes and wiring lines to an outdoor unit. In contrast, the heat utilizing apparatus according to Embodiment 1 eliminates the need for an outdoor unit or includes a downsized outdoor unit. This improves the workability of installation of the heat utilizing apparatus according to Embodiment 1.

In addition, the heat rejection units of the heat utilizing apparatus according to Embodiment 1 can be arranged in an indoor space, such as a dedicated storage room (including a basement), a space under a floor, or a space in a wall, thus allowing the heat utilizing apparatus according to Embodiment 1 to exhibit enhanced resistance to natural disaster, such as typhoon. In other words, this enables the heat utilizing apparatus according to Embodiment 1 to have higher reliability and longer service life.

The traditional heat utilizing apparatuses reject waste heat using air through an outdoor unit. In contrast, according to Embodiment 1, the heat rejection units reject heat using water having a larger heat capacity than air. This leads to less impact on the ambient environment.

Furthermore, according to Embodiment 1, electricity available at low cost, such as nighttime electricity or daytime solar power, (including power that depends on natural resources, such as tidal power and wind power, and excess power that differs from time to time or from area to area) can be used to operate the first heat pump 6 such that heat can be stored in the first heat storage unit 7 and the second heat storage unit 8. Therefore, heating energy or cooling energy necessary for life, business, or industry can be stored at low cost and be utilized depending on application at any time when a user wants to use the energy. Thus, energy conservation and cost reduction can be expected.

The case where the heat medium supply sources 12 supply water such that hot water is supplied to the bath 14 and cold water is supplied to the tap 15 has been described as an example in Embodiment 1. However, the heat medium supply sources 12 may supply air such that hot air and cold air are supplied to indoor spaces. As a matter of course, the heat utilizing apparatus may include both the heat medium supply sources 12 for water supply and the heat medium supply sources 12 for air supply.

To reduce the heat storage amount of either one of the heat storage units, heat is rejected using water as a heat medium in Embodiment 1. However, heat may be rejected using air as a heat medium. The reason is as follows. For example, if the heat storage unit is at or below 0 degrees C. and the heat is rejected using water as a heat medium, the water, serving as a heat medium, can freeze before the water is discharged to the outside of the heat utilizing apparatus.

In contrast, if heat is rejected using air as a heat medium to reduce the heat storage amount of either one of the heat storage units, the air can be discharged irrespective of the temperature of the heat storage unit. Furthermore, if each heat rejection unit has a structure to take air in from a space under a floor and discharge air to the outdoor space, the space under the floor can be dried, thus improving the durability of a house. This can be achieved, as the heat rejection units can be arranged in the indoor space, such as a dedicated storage room (including a basement), a space under a floor, or a space in a wall in Embodiment 1.

The heat utilizing apparatus according to Embodiment 1 may further include a heat-rejection-unit switching device having a function of switching, during reduction of the heat storage amount of either one of the heat storage units, from a mode in which heat is rejected using water as a heat medium to another mode in which heat is rejected using air as a heat medium. The heat-rejection-unit switching device may further have a function of switching the mode in which heat is rejected using air to the mode in which heat is rejected using water during the reduction of the heat storage amount. In other words, the heat-rejection-unit switching device may have a function of switching between media used to reject heat.

Although the first heat pump 6 essentially has a complicated configuration including a valve, a sensor, and other components, the first heat pump 6 has only to generate heating energy and cooling energy through circulation of the heat medium. Therefore, only essential parts of the first heat pump 6 have been described in Embodiment 1. Examples of a material for the first heat storage unit 7 and the second heat storage unit 8 include water, a chemical heat storage material, a sensible heat storage material, and a latent heat storage material. Examples of the chemical heat storage material include hydroxide, carbonate, and ammoniate. Examples of the sensible heat storage material include concrete, cement mortar, and a ceramic heat storage material. Examples of the latent heat storage material include sodium acetate trihydrate and sodium sulfate decahydrate. The ceramic heat storage material is the most preferable material for the first heat storage unit 7 and the second heat storage unit 8.

Embodiment 2

Figure 5:
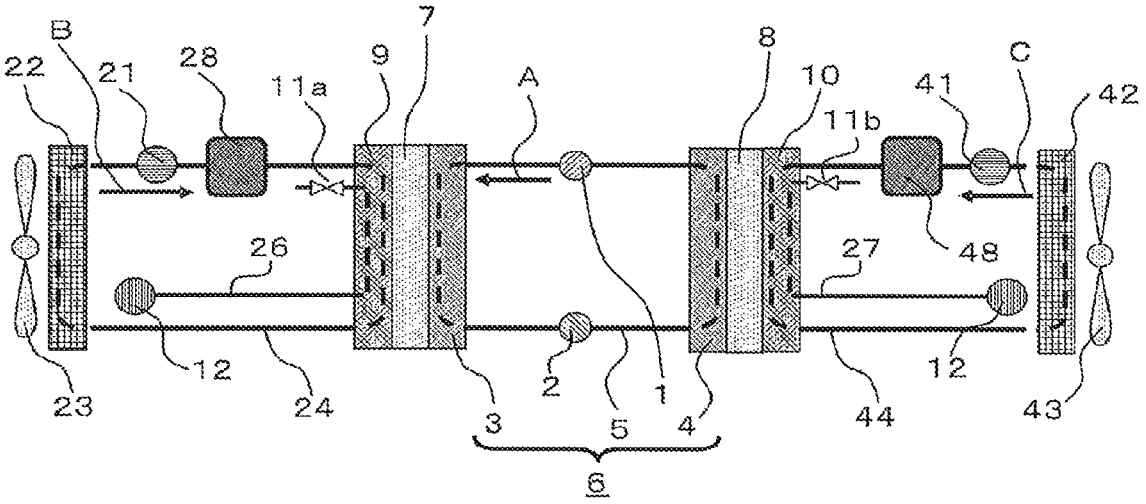
FIG. 5 is a schematic diagram illustrating the configuration of a heat utilizing apparatus according to Embodiment 2 of the present invention and illustrates only a heat cycle portion of the apparatus.

The following description of Embodiment 2 of the present invention will be focused on differences from Embodiment 1 of the present invention. An explanation of the same or equivalent parts as those in Embodiment 1 is omitted in the description of Embodiment 2. FIG. 5 is a schematic diagram illustrating the configuration of a heat utilizing apparatus according to Embodiment 2 of the present invention and illustrates only a heat cycle portion of the apparatus. In other words, FIG. 5 illustrates only the portion corresponding to the insides of the X portions within the dashed lines in FIGS. 1 and 3.

As illustrated in FIG. 5, like the heat utilizing apparatus according to Embodiment 1 of the present invention, the heat utilizing apparatus according to Embodiment 2 includes the first heat pump 6, the first heat storage unit 7, the second heat storage unit 8, the third heat exchanger 9, and the fourth heat exchanger 10. The heat utilizing apparatus according to Embodiment 2 further includes a circuit including the third heat exchanger 9, a first reservoir tank 28, a first pump 21, and a fifth heat exchanger 22 sequentially connected in a closed circuit by a first circulation pipe 24 through which a circulation medium flows. The heat utilizing apparatus according to Embodiment 2 further includes a first fan 23 facing the fifth heat exchanger 22.

The heat utilizing apparatus according to Embodiment 2 further includes a circuit including the fourth heat exchanger 10, a second reservoir tank 48, a second pump 41, and a sixth heat exchanger 42 sequentially connected in a closed circuit by a second circulation pipe 44 through which the circulation medium flows. The heat utilizing apparatus according to Embodiment 2 further includes a second fan 43 facing the sixth heat exchanger 42.

The first pump and the first reservoir tank may be eliminated. It is only required that the third heat exchanger 9 and the fifth heat exchanger 22 are connected by the first circulation pipe 24 and the circulation medium circulates through the first circulation pipe 24. Similarly, the second pump and the second reservoir tank may be eliminated. It is only required that the fourth heat exchanger 10 and the sixth heat exchanger 42 are connected by the second circulation pipe 44 and the circulation medium circulates through the second circulation pipe 44.

Examples of the circulation medium flowing through the first circulation pipe 24 and the second circulation pipe 44 include water and antifreeze (e.g., ethylene glycol solution). It is assumed in Embodiment 2 that, depending on the performance of the first pump 21 and that of the second pump 41, the circulation medium circulates through the first circulation pipe 24 in a direction (indicated by an arrow B in FIG. 5) from the first pump 21 to the first reservoir tank 28 in the circuit including the third heat exchanger 9, or the third heat exchanger 9 side of the first heat pump 6. It is further assumed that the circulation medium circulates through the second circulation pipe 44 in a direction (indicated by an arrow C in FIG. 5) from the second pump 41 to the second reservoir tank 48 in the circuit including the fourth heat exchanger 10, or the fourth heat exchanger 10 side of the first heat pump 6.

An operation of the heat utilizing apparatus according to Embodiment 2 of the present invention will now be described with reference to FIG. 5. In Embodiment 2, it is assumed that the heat medium circulates through the first pipe 5 in the direction (indicated by an arrow A in FIG. 5) from the first compressor 1 to the first heat exchanger 3 in a manner similar to Embodiment 1 of the present invention. Since the operation in the first heat pump 6 is similar to that in Embodiment 1 of the present invention, an explanation of the operation in the first heat pump 6 is omitted.

The third heat exchanger 9 side of the first heat pump 6 will be first described. The circulation medium flowing through the first circulation pipe 24 is pushed out of the first reservoir tank 28 by the first pump 21 and thus circulates through the first circulation pipe 24. Therefore, the third heat exchanger 9 will be first described as a starting point of circulation. The third heat exchanger 9 allows the first heat storage unit 7 to exchange heat with the circulation medium flowing through the first circulation pipe 24. After that, the fifth heat exchanger 22 allows the circulation medium to exchange heat with the outside of the heat utilizing apparatus. Specifically, heat exchanged between the circulation medium flowing through the first circulation pipe 24 and the outside of the heat utilizing apparatus in the fifth heat exchanger 22 is supplied as warm air to the outside of the heat utilizing apparatus through the first fan 23. The term "warm air" as used herein refers to air having a higher temperature than the ambient air of the heat utilizing apparatus before activation of the first heat pump 6.

The fourth heat exchanger 10 side of the first heat pump 6 will now be described. The circulation medium flowing through the second circulation pipe 44 is pushed out of the second reservoir tank 48 by the second pump 41 and thus circulates through the second circulation pipe 44. Therefore, the fourth heat exchanger 10 will be first described as a starting point of circulation. The fourth heat exchanger 10 allows the second heat storage unit 8 to exchange heat with the circulation medium flowing through the second circulation pipe 44. After that, the sixth heat exchanger 42 allows the circulation medium to exchange heat with the outside of the heat utilizing apparatus. Specifically, heat exchanged between the circulation medium flowing through the second circulation pipe 11 and the outside of the heat utilizing apparatus in the sixth heat exchanger 42 is supplied as cold air to the outside of the heat utilizing apparatus through the second fan 43. The term "cold air" as used herein refers to air having a lower temperature than the ambient air of the heat utilizing apparatus before the activation of the first heat pump 6.

Although the case where the fifth heat exchanger 22 and the first fan 23 supply the warm air and the sixth heat exchanger 42 and the second fan 43 supply the cold air has been described with reference to FIG. 5, the fifth heat exchanger 22 or the sixth heat exchanger 42 may transfer heat to a solid wall (e.g., a floor or a wall). If the fifth heat exchanger 22 or the sixth heat exchanger 42 transfers heat to the solid wall, the heat utilizing apparatus will serve as a typical floor heating system, for example. Furthermore, heat transport devices (e.g., a circulation device different from the above-described one, a heat pump different from the above-described one, and a heat pipe) may be used for heat transport or heat distribution to a further remote location. In addition, the fifth heat exchanger 22 and the sixth heat exchanger 42 may be combined into a single component and pipes may be arranged such that the combined component can be shared.

Figure 6:
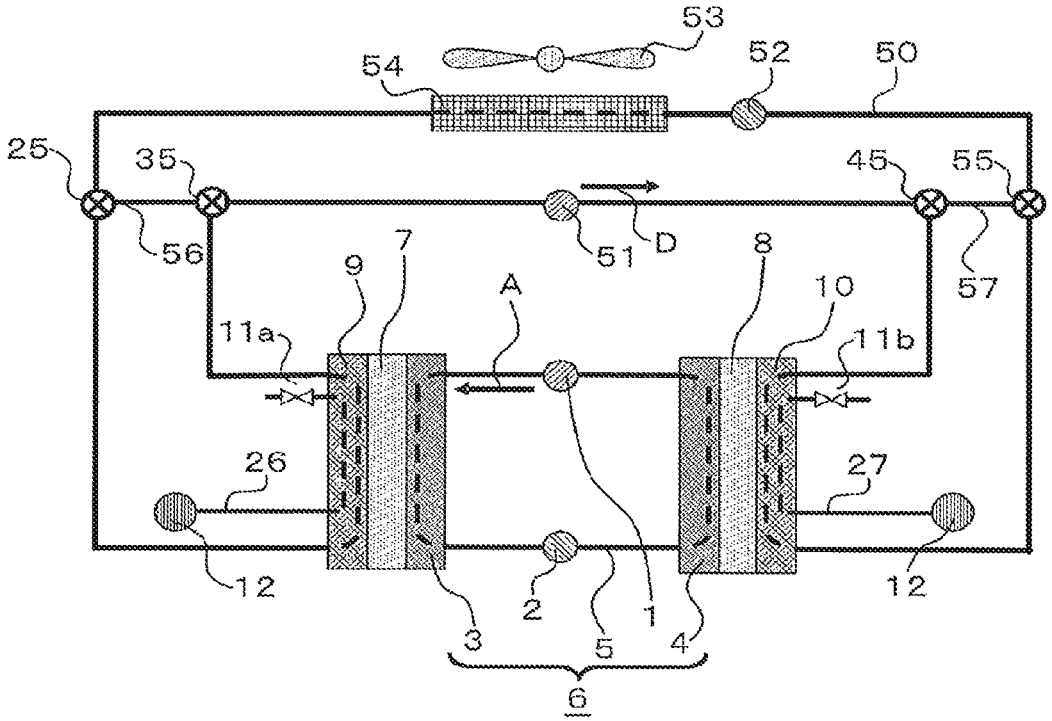
FIG. 6 is a schematic diagram illustrating only a heat cycle portion of a modification of the heat utilizing apparatus according to Embodiment 2 of the present invention.

FIG. 6 is a schematic diagram illustrating only a heat cycle portion of a modification of the heat utilizing apparatus according to Embodiment 2 of the present invention. In other words, FIG. 6 illustrates only the portion corresponding to the insides of the X portions within the dashed lines in FIGS. 1 and 3. A heat utilizing apparatus of FIG. 6 further includes a second heat pump that includes a second compressor 51, a third three-way valve 45, the fourth heat exchanger 10, a fourth three-way valve 55, a second expansion valve 52, a seventh heat exchanger 54, a fifth three-way valve 25, the third heat exchanger 9, and a sixth three-way valve 35 sequentially connected in a closed circuit by a second pipe 50 through which a heat medium flows. In FIG. 6, the second heat pump is connected with the first heat pump 6. Referring to FIG. 6, the fifth three-way valve 25 is connected with the sixth three-way valve 35 by a third pipe 56, and the third three-way valve 45 is connected with the fourth three-way valve 55 by a fourth pipe 57. The heat utilizing apparatus of FIG. 6 further includes a third fan 53 facing the seventh heat exchanger 54.

The arrangement of the pipes in the second heat pump in FIG. 6 is illustrative only. The order in which the components are connected, for example, the position of the second expansion valve, can be appropriately changed depending on the type of heat to be supplied from the seventh heat exchanger 54 to the outside of the heat utilizing apparatus through the third fan 53. In addition, the direction in which the heat medium flows through the second pipe 50 can also be appropriately changed. It is only required that heat can be transferred or transported from the first heat storage unit 7 and the second heat storage unit 8 to a desired heat receiving member (e.g., fluid, solid, or a heat transport device).

An operation of the heat utilizing apparatus of FIG. 6 will now be described. In Embodiment 2, it is assumed that the heat medium circulates through the first pipe 5 in the direction (indicated by an arrow A in FIG. 6) from the first compressor 1 to the first heat exchanger 3 in the first heat pump 6 as in Embodiment 1 of the present invention. It is further assumed that the heat medium circulates through the second pipe 50 in a direction (indicated by an arrow D in FIG. 6) from the second compressor 51 to the third three-way valve 45 in the second heat pump.

Since the heat medium circulates through the second heat pump, the fourth heat exchanger 10 will be first described as a starting point of circulation. In the fourth heat exchanger 10, the heat medium flowing through the second pipe 50 exchanges heat with (or is cooled by) the second heat storage unit 8. The heat medium then passes through the fourth three-way valve 55 and flows to the second expansion valve 52. The heat medium, cooled by heat exchange in the fourth heat exchanger 10, passes through the second expansion valve 52, so that the heat medium enters a lower temperature, lower pressure state than before passing through the second expansion valve 52. The seventh heat exchanger 54 allows the heat medium in the lower temperature, lower pressure state than before passing through the second expansion valve 52 to exchange heat with the outside of the heat utilizing apparatus.

Specifically, heat exchanged between the heat medium flowing through the second pipe 50 and the outside of the heat utilizing apparatus in the seventh heat exchanger 54 is supplied as cold air to the outside of the heat utilizing apparatus through the third fan 53. After that, the heat medium having passed through the seventh heat exchanger 54 flows through the fifth three-way valve 25, the third pipe 56, and the sixth three-way valve 35 to the second compressor 51. The heat medium passes through the second compressor 51, so that the heat medium enters a higher temperature, higher pressure state than before passing through the second compressor 51. The heat medium then passes through the third three-way valve 45 and flows to the fourth heat exchanger 10.

The second heat pump in FIG. 6 functions as an alternative to the circulation circuit including the fourth heat exchanger 10 and the sixth heat exchanger 42 connected by the second circulation pipe 44 in FIG. 5 or an alternative to the circulation circuit including the third heat exchanger 9 and the fifth heat exchanger 22 connected by the first circulation pipe 24 in FIG. 5 depending on, for example, switching of the four three-way valves (the third three-way valve 45, the fourth three-way valve 55, the fifth three-way valve 25, and the sixth three-way valve 35) or the position of the second expansion valve 52. Since the heat utilizing apparatus of FIG. 6 includes the two heat pumps, the amount of heat to be supplied from the heat utilizing apparatus to the outside simply doubles. When the heat utilizing apparatus is intended to produce as much heat as that produced in a heat utilizing apparatus including only one heat pump, the two heat pumps can produce heat with less power.

In an exemplary configuration illustrated in FIG. 6, switching the multiple three-way valves arranged in the second pipe 50 between the components of the heat utilizing apparatus enables the seventh heat exchanger 54 to function as the fifth heat exchanger 22 and the sixth heat exchanger 42 in FIG. 5, and the second compressor 51 and the second expansion valve 52 are arranged in addition to the same compressor and expansion valve as those in FIG. 5. The configuration is not limited to this example. The second heat pump may be disposed on each of the third heat exchanger 9 side and the fourth heat exchanger 10 side of the first heat pump 6 in FIG. 5. In other words, two second heat pumps may be arranged.

Figure 7:
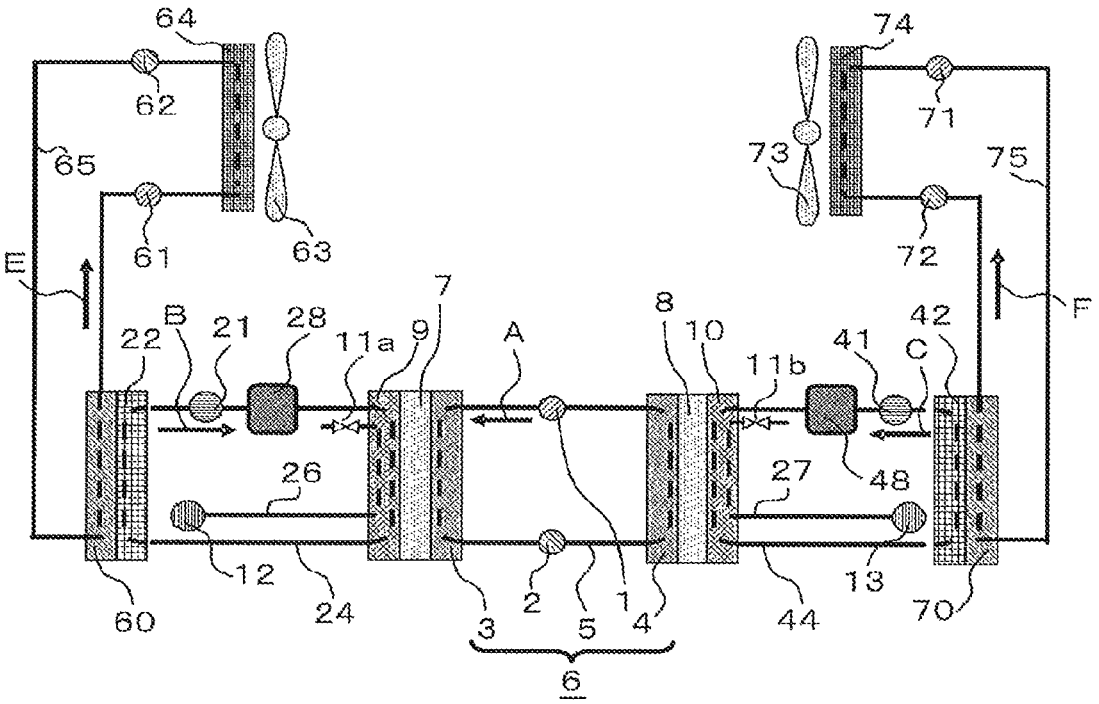
FIG. 7 is a schematic diagram illustrating only a heat cycle portion of another modification of the heat utilizing apparatus according to Embodiment 2 of the present invention.

FIG. 7 is a schematic diagram illustrating only a heat cycle portion of another modification of the heat utilizing apparatus according to Embodiment 2 of the present invention. In other words, FIG. 7 illustrates only the portion corresponding to the insides of the X portions within the dashed lines in FIGS. 1 and 3. A heat utilizing apparatus of FIG. 7 includes, in addition to the same components as those of the heat utilizing apparatus of FIG. 5, a third heat pump that includes an eighth heat exchanger 60, a third compressor 61, a ninth heat exchanger 64, and a third expansion valve 62 sequentially connected in a closed circuit by a fifth pipe 65 and through which the heat medium flowing through the fifth pipe 65 circulates, and further includes a fourth fan 63 facing the ninth heat exchanger 64. The heat utilizing apparatus of FIG. 7 further includes a fourth heat pump that includes a tenth heat exchanger 70, a fourth expansion valve 72, an eleventh heat exchanger 74, and a fourth compressor 71 sequentially connected in a closed circuit by a sixth pipe 75 and through which the heat medium flowing through the sixth pipe 75 circulates, and further includes a fifth fan 73 facing the eleventh heat exchanger 74. The eighth heat exchanger 60 is connected with the fifth heat exchanger 22. The tenth heat exchanger 70 is connected with the sixth heat exchanger 42.

An operation of the heat utilizing apparatus of FIG. 7 will now be described. An explanation of the operation in the same components as those in FIG. 5 is omitted. It is assumed that the heat medium flows through the fifth pipe 65 in a direction (indicated by an arrow E in FIG. 7) from the eighth heat exchanger 60 to the third compressor 61 in the third heat pump. It is further assumed that the heat medium flows through the sixth pipe 75 in a direction (indicated by an arrow F in FIG. 7) from the tenth heat exchanger 70 to the fourth expansion valve 72 in the fourth heat pump.

The operation in the third heat pump will be first described. Since the heat medium circulates through the fifth pipe 65, the eighth heat exchanger 60 will be first described as a starting point of circulation. In the fifth heat exchanger 22 and the eighth heat exchanger 60, the circulation medium in the first circulation pipe 24 exchanges heat with the heat medium in the fifth pipe 65. The heat medium in the fifth pipe 65 is heated by heat exchange in the fifth heat exchanger 22 and the eighth heat exchanger 60. Then, the heat medium in the fifth pipe 65 passes through the third compressor 61, in which the heat medium is pressurized into a higher temperature, higher pressure state than before passing through the third compressor 61. In the ninth heat exchanger 64, the high temperature, high temperature heat medium exchanges heat with the outside of the heat utilizing apparatus. Heat exchanged in the ninth heat exchanger 64 is supplied as warm air to the outside of the heat utilizing apparatus (e.g., an indoor space in a living environment in winter) through the fourth fan 63.

The operation in the fourth heat pump will now be described. Since the heat medium circulates through the sixth pipe 75, the tenth heat exchanger 70 will be first described as a starting point of circulation. In the sixth heat exchanger 42 and the tenth heat exchanger 70, the circulation medium in the second circulation pipe 44 exchanges heat with the heat medium in the sixth pipe 75. The heat medium in the sixth pipe 75 is cooled by heat exchange in the sixth heat exchanger 42 and the tenth heat exchanger 70. Then, the heat medium in the sixth pipe 75 passes through the fourth expansion valve 72, in which the heat medium is expanded into a lower temperature, lower pressure state than before passing through the fourth expansion valve 72. In the eleventh heat exchanger 74, the low temperature, low pressure heat medium exchanges heat with the outside of the heat utilizing apparatus. Heat exchanged between the heat medium in the sixth pipe 75 and the outside of the heat utilizing apparatus in the eleventh heat exchanger 74 is supplied as cold air to the outside of the heat utilizing apparatus (e.g., an indoor space in a living environment in summer) through the fifth fan 73.

Since the heat utilizing apparatus of FIG. 7 includes two heat pumps on each of a heating energy side and a cooling energy side, the amount of heat to be supplied from the heat utilizing apparatus to the outside simply doubles. When the heat utilizing apparatus is intended to produce as much heat as that produced in a heat utilizing apparatus including only one heat pump, the two heat pumps can produce heat with less power.

Each of the heat utilizing apparatuses illustrated in FIGS. 5 to 7 according to Embodiment 2 can offer the same advantages as those in Embodiment 1 of the present invention. The heat utilizing apparatus according to Embodiment 2 can store heating energy and cooling energy produced by the first heat pump 6 and suppress excessive heat storage in the heat storage units. Since the heat utilizing apparatus includes the heat rejection units configured to reduce the heat storage amount of the first heat storage unit when the available capacity of the first heat storage unit is less than that of the second heat storage unit, and reduce the heat storage amount of the second heat storage unit when the available capacity of the first heat storage unit is greater than that of the second heat storage unit, the amount of heat in the heat storage units can be adjusted such that the heat storage amounts of the first and second heat storage units approach each other as closely as possible.

As illustrated in FIG. 4 and FIGS. 5 to 7, each of the first heat storage unit 7 and the second heat storage unit 8 may include one or more heat transport devices or heat receiving members. Combining various components as described above enables desired heat energy to be simultaneously supplied to multiple spaces, resulting in effective utilization of energy.

Examples of end use of heat energy include cooking, hot drinking water, cold drinking water, air-conditioning (including humidifying and drying (of a space under a floor, a space above a ceiling, a bathroom, and a window, for example)), cooling of electric equipment (e.g., an IH cooling heater, a rice cooker, a household electric appliance, and an industrial device), hot water supply (for a bath, a shower, and face washing, for example), washing (e.g., dishwashing in a kitchen, a dishwasher, and outdoor car wash), solid wall heating (for a floor, a wall, a ceiling, and dew condensation prevention), laundry (e.g., laundry with warm water and drying clothes), toilets (e.g., Washlet (registered trademark)), and vivaria (for animals, fishes, insects, and plants, for example), which need heating energy or cooling energy.

As regards a method for reducing the heat storage amount of the heat storage unit, a circuit as illustrated in FIG. 5 can be used. The third heat exchanger 9, the first reservoir tank 28, the first pump 21, and the fifth heat exchanger 22 are sequentially connected in a closed circuit by the first circulation pipe 24. A circuit similar to the closed circuit in which the circulation medium flows through the first circulation pipe 24 may be provided for the second heat storage unit 8. Heat may be rejected from the fifth heat exchanger 22 by flowing of the circulation medium through the closed circuits.

Embodiments 1 and 2 of the present invention can be freely combined with each other and can be appropriately modified and omitted within the scope of the invention. The dimensions, material, and shape of each of the components described as examples in Embodiments 1 and 2 and, for example, the relative arrangement of the components, can be appropriately changed depending on the configuration or various conditions of an apparatus to which the present invention is applied, and the present invention is not limited to these examples. Furthermore, the dimensions of each of the components in the figures may be different from the actual dimensions.

REFERENCE SIGNS LIST

1 first compressor 2 first expansion valve 3 first heat exchanger 4 second heat exchanger 5 first pipe 6 first heat pump 7 first heat storage unit 8 second heat storage unit 9 third heat exchanger 10 fourth heat exchanger 11*a* first heat rejection unit 11*b* second heat rejection unit 11*c* third heat rejection unit 12 heat medium supply source 14 bath 15 tap 16 heating energy pipe 17 cooling energy pipe 18 heating/cooling pipe 19 third three-way valve 20 mixing tank 21 first pump 22 fifth heat exchanger 23 first fan 24 first circulation pipe 25 fifth three-way valve 26 first discharge pipe 27 second discharge pipe 28 first reservoir tank 29 wastewater supply source 31 first three-way valve 32 second three-way valve 35 sixth three-way valve 41 second pump 42 sixth heat exchanger 43 second fan 44 second circulation pipe 45 third three-way valve 48 second reservoir tank 50 second pipe 51 second compressor 52 second expansion valve 53 third fan 54 seventh heat exchanger 55 fourth three-way valve 56 third pipe 57 fourth pipe 60 eighth heat exchanger 61 third compressor 62 third expansion valve 63 fourth fan 64 ninth heat exchanger 65 fifth pipe 70 tenth heat exchanger 71 fourth compressor 72 fourth expansion valve 73 fifth fan 74 eleventh heat exchanger 75 sixth pipe 100*a* first measurement unit 100*b* second measurement unit 101 determination unit 102 control unit

The invention claimed is:

1. A heat utilizing apparatus comprising:

a heat pump including a compressor, a first heat exchanger, an expansion valve, and a second heat exchanger sequentially connected in a closed circuit by a pipe through which a heat medium circulates;

a first heat storage material configured to store heat exchanged in the first heat exchanger;

a second heat storage material configured to store heat exchanged in the second heat exchanger;

a third heat exchanger configured to exchange heat with the first heat storage material;

a fourth heat exchanger configured to exchange heat with the second heat storage material;

a first measurement unit configured to measure a heat storage amount of the first heat storage material;

a second measurement unit configured to measure a heat storage amount of the second heat storage material;

a first heat rejection valve configured to reduce the heat storage amount of the first heat storage material;

a second heat rejection valve configured to reduce the heat storage amount of the second heat storage material; and circuitry configured to determine, in accordance with a measurement result of the first measurement unit and a measurement result of the second measurement unit, whether to reduce the heat storage amount of the first heat storage material or the heat storage amount of the second heat storage material, the circuitry further configured to control the first heat rejection valve or the second heat rejection valve in accordance with a determination result of the circuitry, wherein the first heat storage material is disposed between the first heat exchanger and the third heat exchanger.

2. The heat utilizing apparatus of claim 1, wherein the circuitry is configured to compare a difference between the heat storage amount of the first heat storage material and a heat storage capacity of the first heat storage material with a reference value or compare a ratio of the heat storage amount of the first heat storage material to the heat storage capacity of the first heat storage material with a reference value.

3. The heat utilizing apparatus of claim 1, wherein the circuitry is configured to compare a difference between an available capacity of the first heat storage material and a heat storage capacity of the first heat storage material with a reference value or compare a ratio of the heat storage capacity of the first heat storage material to the available capacity of the first heat storage material with a reference value.

4. The heat utilizing apparatus of claim 1, wherein the circuitry is configured to compare an available capacity of the first heat storage material with an available capacity of the second heat storage material.

5. The heat utilizing apparatus of claim 1, wherein the circuitry is configured to compare the heat storage amount of the first heat storage material with a heat storage amount of the second heat storage material.

6. The heat utilizing apparatus of claim 1, wherein the first heat storage material and the second heat storage material have different heat storage capacities.

7. The heat utilizing apparatus of claim 1, wherein the first measurement unit is configured to calculate the heat storage amount of the first heat storage material from the temperature of the first heat storage material and the second measurement unit is configured to calculate a heat storage amount of the second heat storage material from the temperature of the second heat storage material.

8. The heat utilizing apparatus of claim 1, wherein the first heat rejection valve is connected with a first discharge pipe extending through the third heat exchanger, and the second heat rejection valve is connected with a second pipe extending through the fourth heat exchanger, the heat storage amount of the first heat storage material is reduced by using, as a heat medium, water flowing through the first discharge pipe, and the heat storage amount of the second heat storage material is reduced by using, as a heat medium, water flowing through the pipe.

9. The heat utilizing apparatus of claim 1, wherein the first heat rejection valve is connected with a first discharge pipe extending through the third heat exchanger, and the second heat rejection valve is connected with a second pipe extending through the fourth heat exchanger, the heat storage amount of the first heat storage material is reduced by using, as a heat medium, water flowing through the first discharge pipe, the heat storage amount of the first heat storage material or the second heat storage material is reduced by using, as a heat medium, domestic wastewater flowing through the second discharge pipe.

* * * * *